United States Patent [19]

La Grange et al.

[11] Patent Number: 4,680,437

[45] Date of Patent: Jul. 14, 1987

[54] ADJUSTABLE FLOAT ASSEMBLY FOR PUMPS

[75] Inventors: Nyle D. La Grange; Darryl M. Nielsen, both of Lenexa, Kans.; Joe A. Harbison, Gladstone, Mo.

[73] Assignee: The Marley-Wylain Company, Mission, Kans.

[21] Appl. No.: 818,011

[22] Filed: Jan. 13, 1986

[51] Int. Cl.[4] ..... H01H 35/18

[52] U.S. Cl. ..... 200/84 R; 200/302.1; 340/625; 73/308; 73/318

[58] Field of Search ..... 340/623, 624, 625; 73/308, 313, 318, 321; 307/118; 200/84 R, 84 C, 302

[56] References Cited

U.S. PATENT DOCUMENTS

| | | | |
|---|---|---|---|
| 2,816,973 | 12/1957 | Beck | 340/625 |
| 3,545,272 | 12/1970 | McGill | 340/623 |
| 4,230,578 | 10/1980 | Culp | 340/623 |
| 4,262,216 | 4/1981 | Johnston | 200/84 R |

*Primary Examiner*—G. P. Tolin

*Attorney, Agent, or Firm*—Schmidt, Johnson, Hovey & Williams

[57] ABSTRACT

A float assembly for use in tanks, sumps or other liquid-containing vessels includes an elongated, upright, extruded support which maintains individual float switches at preselected heights. The support includes upright, elongated, recess-defining walls with a pair of flat, spaced, parallel sidewall portions that are configured to grippingly engage an outer, deformable insulative covering of a cord connected to the float switch. The cord may be grasped and pulled to an appropriate height, and is thereafter secured by the sidewall portions without the use of tools, fasteners or other components. In preferred forms, the recess-defining walls have a transverse, generally U-shaped configuration with an internal passageway for housing an upper portion of the cord between the float switch and an overlying junction box.

13 Claims, 5 Drawing Figures

ADJUSTABLE FLOAT ASSEMBLY FOR PUMPS

BACKGROUND OF THE INVENTION

1. Field of the Invention

The present invention relates to an electrical float switch assembly for use in tanks or sumps. The assembly includes an upright support having elongated, recess-defining walls configured to crimpingly engage an outer deformable covering of a float switch electric cord at a preselected height.

2. Description of the Prior Art

Electric float switches for pumps are often used in combination with tanks, sumps and other liquid-holding vessels. In general, such float switches initiate pump operation when the level of liquid reaches a certain height in the tank, and then interrupt operation of the pump after the liquid level falls. In some instances, a second float switch is provided and disposed in overlying relationship to the first switch and is operable to activate a second, backup pump should the first pump fail or otherwise be insufficient for removing liquid from the tank at a proper flow rate. Moreover, a third float switch is occasionally utilized for activating an alarm system whenever the tank liquid level rises to an untolerable height.

As is known, float switches in combination with gravity fed tanks are widely used in various applications, ranging from large scale systems in process industries to smaller scale, commercial or residential use as for pumping sewage or excess ground water. Recently, for example, low pressure sewage systems have become increasingly popular in smaller communities, since holding tanks can temporarily retain a preselected quantity of the sewage and grinder pumps can be intermittently activated to pump the sewage through small diameter, plastic pipe, avoiding the need for major excavation, costly large diameter pipe or other capital intensive components.

Oftentimes, float switches comprise a lightweight, floatable, foam-filled housing internally containing a mercury switch. The switch is electrically connected to an insulated, flexible electric cord, and the latter is secured to a tank sidewall or other support at a certain height and at a distance spaced from the switch housing, such that the length of cord between the point of securement to the tank sidewall and the switch housing enables the switch to freely move in response to any buoyancy forces presented by liquid in the tank. When the liquid level in the tank is below the switch, the latter assumes a somewhat vertical, hanging orientation wherein the switch contacts are open. However, as the liquid level in the tank approaches the height of the switch, the housing is buoyed and the mercury switch shifts to a horizontal orientation, thereby closing the switch contacts and activating the pump or other electrical device. Subsequently, when the water level in the tank falls below the position of the switch, the latter again returns to a more vertical or hanging orientation to simultaneously open the switch contacts and interrupt operation of the pump.

In the past, a variety of methods have been proposed for adjustably positioning the float switch at a preselected height in order to maintain tank liquid levels within certain desired bounds. Typically, a portion of the switch cord is secured at a certain vertical position by an arrangement of hardware including nuts and bolts, and consequently such practice requires a multiplicity of components as well as wrenches and other tools for adjusting the switches in the field. In other cases, the cord is simply tied in an upright support by a rope or wire. Unfortunately, such prior practices do not lend themselves to easy, quick field installation and are generally unsatisfactory in one respect or another.

SUMMARY OF THE INVENTION

The present invention overcomes the disadvantages of the prior art by provision of a novel float assembly including an upstanding extruded support which is operable to grippingly engage a float switch cord at any preselected height and thereby preset the tank liquid levels at which a pump or other device is automatically actuated. Moreover, the extrusion provides an elongated, vertically oriented passageway for securely retaining and protecting the remaining portion of the cord between the height of the float switch and an overlying, adjacent junction box.

In more detail, the support of the float assembly has elongated, upright walls defining a generally U-shaped recess. The recess walls include a pair of outwardmost, flat, parallel sidewall portions which are spaced at a distance smaller than the outer diameter of the cord. The cord is deformable for insertion into a position between the sidewalls and the interference fit between the cord and the sidewalls is sufficient to grippingly engage the cord and maintain the float switch at a preselected height.

Optionally, a formed, stainless steel standoff may be inserted into the lowermost end of the support in order to prevent excessive shifting of the latter and maintain the support at a debris-free location spaced from the tank sidewalls. The upper end of the support is provided with a pair of threaded bores for connection to an overlying junction box. A compression plate, in cooperation with a compression gasket, are positioned between the junction box and the support to substantially preclude fluid leakage in an area where the cord enters the junction box.

DETAILED DESCRIPTION OF THE DRAWINGS

Figures 1, 2, 3, 4, 5:
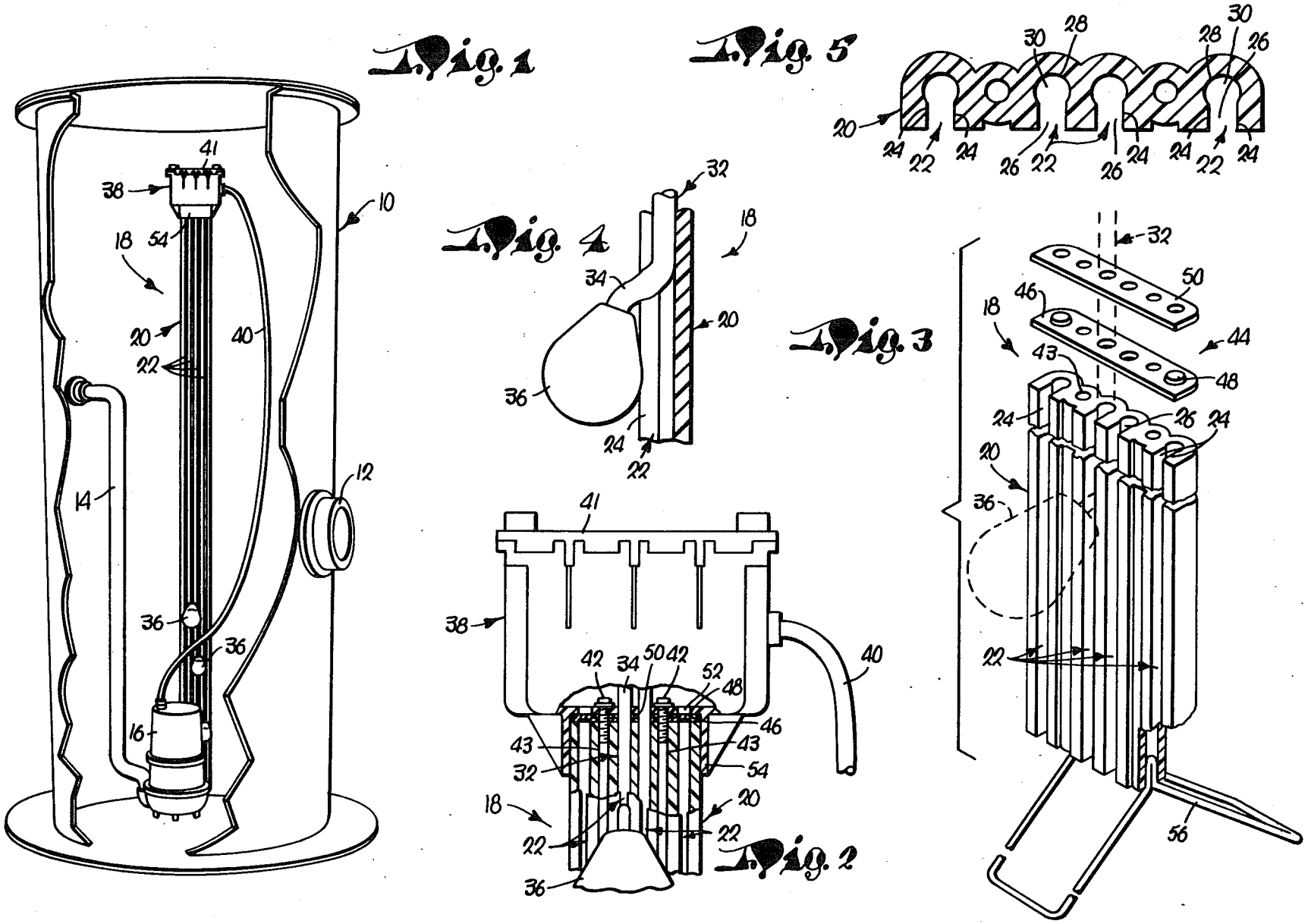
FIG. 1 is a side elevation view with parts broken away for clarity to reveal the adjustable float assembly of the instant invention positioned within a tank along with a grinder pump and a discharge conduit.
FIG. 2 is an enlarged, fragmentary, front elevational view of the adjustable float assembly of FIG. 1 with parts broken away in section to reveal the connection between an upright extruded support of the float assembly and an overlying junction box.
FIG. 3 is an enlarged, fragmentary, perspective, exploded view illustrating a gasket and compression plate for enabling a water resistant seal between the upright support of FIG. 2 and the junction box.
FIG. 4 is a fragmentary, enlarged, side sectional view depicting a portion of a switch cord of the float assembly of FIG. 1 in captured disposition within a recess of the housing.
FIG. 5 is an enlarged, horizontal sectional view of the float support shown in FIG. 1.

Referring initially to FIG. 1, an upright, cylindrical tank 10 has an inlet 12 and an outlet conduit 14. A pump 16, disposed adjacent a lowermost portion of the tank 10, is connected to a lower end of the conduit 14. An adjustable float assembly, broadly designated by the numeral 18, is operable to selectively actuate the pump 16 for directing liquids through the outlet conduit 14 whenever the level of liquid in the tank 10 reaches a certain, preselected length.

In more detail, the float assembly 18 comprises an extruded, elongated, vertically oriented support 20 having upright, elongated walls defining four recesses 22. As shown in FIG. 5, the recess walls include a pair of flat, substantially parallel sidewall portions 24, 24 which define a compression channel 26 of the recess 22. Additionally, the recess walls further include an upright, generally cylindrical rear wall portion 28 which defines a passageway 30 of the recess 22. Thus, the recess 22 is of generally U-shaped configuration in a direction transverse to the longitudinal axis of the support 20, although the passageway 30 is of a diameter somewhat larger than the distance between the opposed sidewall portions 24, 24.

Furthermore, the float assembly 18 of the present invention includes a flexible, elongated electrical lead means or cord 32 which is operably coupled to the pump 16. The cord 32 includes structure comprising an outer, deformable covering 34 of electrically insulative material such as synthetic rubber or the like.

As illustrated in FIG. 4, the assembly 18 also includes a switch means or float switch 36 that is electrically connected to the cord 32 and is operably responsive to the presence of fluid. Optionally, the switch 36 may include an outer, foam-filled, floatable housing and an internal mercury switch which is closed whenever the switch 36 assumes a generally horizontal, floating orientation and is open whenever the switch 36 is disposed in a somewhat vertical, hanging disposition.

The parallel sidewall portions 24, 24 of the support 20 are complementally configured to grippingly engage the covering 34 of the cord 32 and retain a portion of the covering 34 at any selected vertical position along the length of the recess 22. In particular, the distance between the sidewall portions 24, 24 is less than the normal diameter of the deformable covering 34 in order to provide frictional retentive forces sufficient to firmly grasp the cord 32 at a selected height. In practice, good results have been obtained when the cord outer covering 34 is comprised of synthetic rubber material having a normal diameter of 0.310″±0.010″, and when in contrast the transverse distance between the opposed sidewall portions 24, 24 is 0.280″±0.010″.

Viewing FIG. 2, a junction box 38 is positioned adjacent the upper end of the support 20 for establishing electrical connection between the cord 32 of the float assembly 18 and a wire 40 operably connected to the pump 16. The box 38 includes an upper removable cover 41 and is coupled to the support 20 by means of a pair of screws 42, 42 which threadably engage respective bores 43, 43 of the support 20 (see also FIG. 5).

Referring to FIG. 3, a sealing means 44 generally precludes the entry of fluids into the junction box 38 in an area adjacent the cords 32 at the upper ends of the recesses 22. The sealing means 44 comprises a substantially rigid compression plate 46 having knockouts 48 that can be selectively removed to accommodate a desired number of cords 32. A resilient gasket 50, having holes similar in orientation to the passageways 30 as well as matching orifices 52 in the bottom of the box 38, is disposed between the plate 46 and the box 38 in order to compressingly and sealingly engage the outer covering 34 of cords 32 passing therethrough and thereby resist the entry of fluids into the box 38. Moreover, the junction box 38 has an outwardly extending, tubular, generally rectangular flange body 54 which surrounds the gasket 50, the plate 46 as well as an upper portion of the support 20 to facilitate alignment of the components during installation and provide additional strength to the assembly 18 thereafter.

Finally, as illustrated in FIG. 3, the assembly 18 preferably includes a formed, stainless steel standoff 56 which has upstanding legs that are insertably received within lowermost portions of the bores 43. The standoff 56 generally retains the support 20 in upright disposition away from the sidewalls of the tank 10 where debris and other material may tend to accumulate. Also, the standoff 56 is operable to minimize lateral deflection of the support 20 whenever incoming flow of liquids through the inlet 12 is particularly heavy.

During installation of the assembly 18, an upper portion of the cord 32 is positioned within the passageway 30 such that the cord extends upwardly through the plate 46, the gasket 50 and into the junction box 38. At the same time, a lower portion of the cord 32 is positioned to extend outwardly from the passageway 30, through the compression channel 26 between the opposed sidewall portions 24, 24 and out toward an area away from the support 20. Preferably, the diameter of the passageway 30 is greater than the outer diameter of the covering 34 to permit vertical adjustment of the float switch 36 to any one of a number of preselected locations. As an example, when the cord 32 has a diameter of 0.300″, good results have been obtained when the diameter of the passageway 30 is approximately 0.340″.

Thus, it can be appreciated that the configuration of the sidewall portions 24, 24 present frictional retentive forces to the covering 34 at a location on the cord 32 where the latter extends outwardly from the passageway 30. The remaining, uncaptured portion of the cord 32, being of flexible nature, enables the float switch 36 to freely move up or down in response to the height of fluid within the tank 10. As an alternative to adjusting the height of the switch 36 by shifting the cord 32 longitudinally within the passageway 30, it should be realized that the cord 32 may be simply grasped and pulled outwardly from the support 20 to provide additional cord length, although such practice may result in an excessive exposed length of the cord 32 such that unintentional tangling or interference with other objects within the tank 10 may occur.

As can now be understood by those skilled in the art, the float assembly 18 of the instant invention provides a means for securely and rapidly positioning the operative height of the float switch 36 so that the precise level of fluids within the tank 10 can be adjusted in the field without the use of separate components such as bolts, nuts or wire ties which might otherwise be lost. The extruded support 20 is virtually resistant to corrosion within a waste water environment. Moreover, the support 20 as shown in FIG. 1 can accommodate a plurality of float switches 36 at various heights, in order to initiate backpumps or alarm systems should the pump 16 become inadequate for maintaining proper discharge flow rates of the effluent from the tank 10.

We claim:

1. A fluid level indicator assembly comprising:

a support having a pair of elongated, upright wall portions spaced from each other to define an elongated channel therebetween which extends in an upright direction and which is open in horizontal directions;

an elongated electrical lead means extending through said open channel in a generally horizontal direction and having structure engaged with both of said wall portions; and switch means electrically connected to said lead means and being operably responsive to the pressure of fluid, said spacing between said pair of wall portions being complementally configured to said lead means structure to engage said pair of wall portions to grippingly engage said structure at any one of a number of vertical, selected positions along the length of said channel while enabling said lead means in each of said positions to extend through said channel in a generally horizontal direction to thereby adjustably position the height of said switch means.

2. The invention of claim 1, wherein said lead means structure comprises an outer deformable covering of electrically insulative material.

3. The invention of claim 2, wherein said channel comprises a portion of an elongated, upright recess having a generally U-shaped configuration in a direction transverse to the longitudinal axes of said wall portions.

4. The invention of claim 2, wherein said wall portions are generally flat and generally parallel to each other, the distance between said wall portions being less than the normal thickness of said lead means outer covering for providing frictional retentive forces to said lead means covering.

5. The invention of claim 4, wherein said support further includes a rear wall portion configured to present less frictional retentive forces to said lead means covering than said frictional retentive forces presented by said pair of generally flat wall portions.

6. The invention of claim 5, wherein said recess has an upper opening; and including:

a junction box means having an orifice, a portion of said lead means extending through said upper opening and said orifice and into said junction box means; and sealing means for generally precluding the entry of fluids into said junction box means in the vicinity of said orifices, said sealing means including a substantially rigid plate disposed adjacent said recess upper opening, and gasket means disposed between said plate and said junction box means, said gasket means and said plate having holes receiving said lead means therethrough, said sealing means including means clamping said junction box means to said support and thereby compressing said gasket means between said plate and said junction box means in order to bring said gasket means into sealing engagement with said lead means.

7. The invention of claim 1, wherein said support is stationary and said lead means structure is selectively vertically shiftable along said channel.

8. The invention of claim 3, wherein a portion of said lead means is disposed in said recess in generally parallel disposition to the longitudinal axis of said pair of wall portions.

9. The invention of claim 1, wherein one of said lead means structure and said piar of wall portions is deformable, and said pair of wall portions is configured to present an interference fit with said structure.

10. The invention of claim 9, wherein said support has an upper portion adapted for connection with an electrical junction box.

11. A water resistant, electrical fluid level indicator assembly comprising:

an upstanding elongated, substantially rigid support having elongated, upright walls defining a recess with an upper opening;

an elongated electrical lead having an outer insulative covering, a portion of said lead being disposed with said recess;

a switch electrically connected to said lead and being operably responsive to the presence of fluid;

a junction box having a lower, generally horizontal wall defining an orifice aligned with said opening of said support, a portion of said lead extending through said upper opening and said orifice and into said junction box; and means for generally precluding the entry of fluids into said junction box in the vicinity of said orifice and for securely connecting said junction box to said support, said means including a substantially rigid plate disposed adjacent said recess upper opening, and a gasket disposed between said plate and said lower wall of said junction box, said gasket and said plate having holes receiving said lead therethrough, said means including a fastener extending in an upright direction and interconnecting said lower wall of said junction box and said support and compressing said gasket between said plate and said lower wall of said junction box in order to bring said gasket into sealing engagement with said lead while rigidly securing said junction box to said support.

12. The invention as set forth in claim 11, wherein said means includes a plurality of screws extending through said lower wall of said junction box.

13. The invention as set forth in claim 11, wherein said junction box is provided with an outwardly extending, tubular body complementally configured to receive a portion of said support adjacent said upper opening, to thereby facilitate alignment of said junction box to said support.

* * * * *

UNITED STATES PATENT AND TRADEMARK OFFICE

CERTIFICATE OF CORRECTION

PATENT NO. : 4,680,437
DATED : July 14, 1987
INVENTOR(S) : Nyle D. La Grange et al It is certified that error appears in the above—identified patent and that said Letters Patent is hereby corrected as shown below:

Column 5, line 8, cancel "pres-"

line 9, cancel "sure" and insert --presence--.

Column 6, line 11, claim 9, cancel "piar" and insert --pair--.

Signed and Sealed this

Ninth Day of March, 1993

*Attest:*

STEPHEN G. KUNIN

*Attesting Officer*

*Acting Commissioner of Patents and Trademarks*